US010792802B2

(12) United States Patent
Simma

(10) Patent No.: US 10,792,802 B2
(45) Date of Patent: Oct. 6, 2020

(54) HAND TOOL COMPRISING VIBRATION DAMPING ELEMENTS

(71) Applicant: C. & E. Fein GmbH, Schwaebisch Gmuend-Bargau (DE)

(72) Inventor: Tobias Simma, Donzdorf (DE)

(73) Assignee: C. & E. Fein GmbH, Schwaebisch Gmuend-Bargau (DE)

( * ) Notice: Subject to any disclaimer, the term of this patent is extended or adjusted under 35 U.S.C. 154(b) by 474 days.

(21) Appl. No.: 15/270,509

(22) Filed: Sep. 20, 2016

(65) Prior Publication Data

US 2017/0008160 A1 Jan. 12, 2017

Related U.S. Application Data

(63) Continuation of application No. PCT/EP2015/055144, filed on Mar. 12, 2015.

(30) Foreign Application Priority Data

Mar. 20, 2014 (DE) ..... 10 2014 103 856

(51) Int. Cl.
*B25F 5/00* (2006.01)
*B25F 5/02* (2006.01)

(52) U.S. Cl.
CPC ..... *B25F 5/006* (2013.01); *B25F 5/001* (2013.01); *B25F 5/02* (2013.01)

(58) Field of Classification Search
CPC .. B25F 5/006; B25F 5/001; B25F 5/02; B25F 15/0075; B24B 23/00; B24B 23/04;
(Continued)

(56) References Cited

U.S. PATENT DOCUMENTS 3,481,655 A * 12/1969 Campbell ..... F16C 35/077 384/536
3,693,035 A 9/1972 Ostwald
(Continued)

FOREIGN PATENT DOCUMENTS

DE 102005052428 A1 5/2007
DE 102006027774 A1 12/2007
(Continued)

*Primary Examiner* — Dariush Seif
(74) *Attorney, Agent, or Firm* — Muncy, Geissler, Olds & Lowe, P.C.

(57) ABSTRACT

A hand tool having a tool spindle that can be driven rotatingly oscillatingly, with an outer housing having a gripping region, an inner housing that is at least partially arranged within the outer housing and coupled therewith, and further having a drive unit including a drive shaft that can be driven rotatingly. The drive unit is received within the inner housing. The drive shaft defines a drive axis. The outer and the inner housings are coupled with each other by a deformable damping element, which in the non-mounted state is formed plate-shaped. The damping element in a mounted state defines a peripheral section and an axial section. The peripheral section in the mounted state is configured for transmitting radial forces between the outer housing and the inner housing. The axial section in the mounted state is configured for transmitting axial forces between the outer housing and the inner housing.

19 Claims, 6 Drawing Sheets

(58) Field of Classification Search
CPC ..... B23Q 5/027; B27B 19/006; F16F 1/36; B25D 17/24
USPC ..... 173/162.2, 95, 114
See application file for complete search history.

(56) References Cited

U.S. PATENT DOCUMENTS 4,140,446 A * 2/1979 Fernstrom ..... B25D 17/24 415/904
5,394,039 A * 2/1995 Suchdev ..... B25D 17/24 173/162.2
6,951,046 B2 * 10/2005 Robinson ..... B25F 5/006 16/430
7,753,137 B2 * 7/2010 Aeberhard ..... B25F 5/001 173/162.1
2004/0216907 A1 11/2004 Happ et al.
2007/0060030 A1 3/2007 Pollak et al.
2007/0143966 A1 * 6/2007 Fischer ..... B25F 5/006 16/422
2007/0246237 A1 * 10/2007 Homsi ..... B25F 5/006 173/213
2007/0295521 A1 * 12/2007 Wiker ..... B24B 23/028 173/162.1
2007/0295522 A1 * 12/2007 Bohne ..... B25D 17/043 173/162.2
2008/0202784 A1 * 8/2008 Stierle ..... B25F 5/006 173/162.1
2010/0193209 A1 * 8/2010 Schadow ..... B24B 23/04 173/162.2
2010/0314147 A1 * 12/2010 Muller ..... B25F 5/006 173/171
2011/0180286 A1 * 7/2011 Oomori ..... B25F 5/008 173/20
2012/0012353 A1 * 1/2012 Foerster ..... B25F 5/006 173/162.2
2012/0111595 A1 * 5/2012 Schadow ..... B25F 5/006 173/162.2
2012/0118599 A1 * 5/2012 Schadow ..... B25F 5/006 173/162.2
2013/0196203 A1 * 8/2013 Wackwitz ..... B25F 5/00 429/96
2013/0209017 A1 * 8/2013 Schadow ..... B24B 23/028 384/536
2014/0265079 A1 * 9/2014 Spielvogel ..... F01B 3/0073 267/163
2015/0034347 A1 2/2015 Hess et al.

FOREIGN PATENT DOCUMENTS

DE 102009002967 A1 11/2010
DE 102011113737 A1 3/2013
DE 102012103587 A1 10/2013
GB 2432036 A 5/2007
WO 2005102605 A1 11/2005

* cited by examiner

HAND TOOL COMPRISING VIBRATION DAMPING ELEMENTS

CROSSREFERENCES TO RELATED APPLICATIONS

This application is a continuation of international patent application PCT/EP2015/055144, filed on Mar. 12, 2015 designating the U.S.A., which international patent application has been published in German language and claims priority from German patent application 10 2014 103 856.8, filed on Mar. 20, 2014. The entire contents of these priority applications are incorporated herein by reference.

BACKGROUND OF THE INVENTION

The invention relates to a hand tool, in particular a hand tool comprising a tool spindle that can be driven rotatingly oscillatingly, comprising an inner housing that at least partially is received within an outer housing and coupled therewith vibration muted, wherein in the inner housing there is received a drive unit comprising a drive spindle that can be driven rotatingly.

Such a hand tool is known from DE 10 2012 103 587 A1. The known hand tool comprises an outer housing extending substantially along a longitudinal axis and a drive unit received within the outer housing, wherein the drive unit is coupled to the outer housing by means of elastic power transmission elements.

In other words in the known hand tool the outer housing is vibrationally decoupled from the motor unit. Vibrations which e.g. are generated by the drive unit or by a tool unit coupled therewith are transmitted onto the outer housing only muted, if all. A user may grip the hand tool at its outer housing or may grip around it, respectively. Thus a vibration level sensed by the user can be reduced.

Hand tools may commonly also be designated as power-driven hand tools. The hand tools may comprise drive units, in particular electric drive motors. Hand tools usually can be designed as hand-guided or hand-held tools. Thus a user may grip a housing of the hand tool with one hand or with both hands to be able to guide the hand tool as desired, when in use. Hand tools with tool spindles that can be driven rotatingly oscillatingly usually are designated as oscillatory tools. Hand tools with a rotary oscillatory drive can be used for a plurality of sawing tasks, cutting tasks, scraping tasks, grinding tasks or similar work. Usually such hand tools have oscillating frequences in the range of about 10.000 to 25.000 oscillations per minute. The oscillations basically may be performed at a small pivot angle which for instance is between 0.5 degrees and 7 degrees.

However, it should be understood that hand tools basically may also be equipped with a rotary drive with constant direction of rotation part-time or full-time. However, such hand tools may be also be designed as angle grinders, hand saws or similar.

Lately the reduction of the vibration level sensed by the user has become more important. Thus for instance in commercial use there exist so-called maximum exposure doses which may limit the maximum operating time of a hand tool per day. At a given maximum exposure dose as well as a vibration level of a hand tool obtained by a computation or empirically, thus a maximum admissible operating time can be determined, in particular a daily operating time. Long-lasting high frequent vibrations may be detrimental to health. Although long-time effects usually do not occur, if a hand tool is only used occasionally, however, may become relevant when hand tools are used professionally or permanently.

The reduction of the vibration level is basically desirable. However an effective implementation comes with various challenges. At the one hand often a design of a hand tool that is vibrationally decoupled comes together with a weight increase—at least to a small degree. Basically this can be explained, since the housing of the hand tool is designed with an outer part and an inner part which are distant from each other by vibration-muting elements.

A further challenge may be the so-called guiding accuracy. Namely, if basically an inner housing is decoupled from an outer housing for damping vibrations, then on the other hand the user also can only operate by means of the soft vibration-damping elements of the inner housing and thus onto a tool received thereon. However, usually with hand-guided or hand-held hand tools feed forces are exerted by the user himself. Since with a vibrationally decoupled design there is no stiff connection between the outer part and the inner part of the housing, the forces exerted by the user may lead to respective deformations between the outer housing and the inner housing. This may in particular affect works that require a high accuracy and precision.

SUMMARY OF THE INVENTION

In view of this it is a first object of the invention to disclose a hand tool, in particular a hand tool comprising a tool spindle that can be driven rotatingly oscillatingly, that allows to be used with reduced vibration exposure.

It is a second object of the invention to disclose a hand tool that can be manufactured with little design effort and manufacturing effort.

It is a third object of the invention to disclose a hand tool that is be suitable also for long-time operations (permanent operation) having little vibrations.

It is a third object of the invention to disclose a hand tool having little vibrations and a long-life drive and preferably having a sufficiently compact design.

According to one aspect of the invention these and further objects are achieved by a hand tool comprising:

an outer housing having at least a gripping region; an inner housing being at least partially arranged within said outer housing and being coupled therewith vibration-muted;

a drive unit received within said inner housing including a drive shaft which can be driven rotatingly;

a tool spindle received within said inner housing;

a gear received within said inner housing coupled to said drive shaft and to said tool spindle for driving said tool spindle about a longitudinal axis thereof;

at least one deformable damping element coupling said outer housing and said inner housing, said damping element in a non-mounted state being substantially plate-shaped forming a peripheral section and an axial section;

wherein said peripheral section in said mounted state is generally configured for transmitting radial forces between said outer housing and said inner housing;

and wherein said axial section in said mounted state is generally configured for transmitting axial forces between said outer housing and said inner housing.

Namely, according to the invention there can be effected a vibrational decoupling between the outer housing and the inner housing at substantially low effort, using simply designed parts. The damping element or the damping elements in the non-mounted state may have a substantially flat design, such as in the shape of a prismatic plate. The non-mounted state of the damping element may correlate with a non-loaded, released position. The plate-shaped damping element now during the assembly of the hand tool may be deformed in a suitable way for providing the peripheral section and the axial section, whereby in a defined way radial and axial forces between the outer housing and the inner housing may be received and transmitted.

The damping element may also be designated as a plate element or a biasing element. The damping element usually is designed at least partially elastically. The damping element may be designed for example of elastic materials, rubber materials, thermoplastic elastomers or similar materials. The damping element at least partially may work vibrationally decoupling between the inner housing and the outer housing. The damping element commonly may also be designated as an anti-vibration element.

Since the damping element in the mounted state is configured for transmitting axial forces and radial forces between the outer housing and the inner housing, the damping element also may assist for securing an axial and a radial position between the inner housing and the outer housing.

According to various developments it is desired that the at least one damping element in the mounted or non-mounted state consists of the peripheral section and the axial section. This may include that in the mounted state a defined bending edge or folding edge may be present within the damping element, separating the peripheral and the axial section.

Since the at least one damping element is deformable at least partially, it may—starting from its simple, plate-shaped form in the non-mounted state—in the mounted state take relatively complicated contours and shapes. The at least one damping element may be manufactured and provided in a cost-effective way.

According to a further development of the hand tool the outer housing is assigned to a gripping side, wherein the inner housing with the drive unit is assigned to a drive side, and wherein the peripheral section and the axial section of the at least one damping element, preferably the peripheral sections and the axial sections of a plurality of damping elements, each define a peripheral distance and an axial distance between the outer housing and the inner housing.

The gripping side generally is the side of the hand tool which is gripped and held by the user. The drive side of the hand tool generally is the side at which the drive unit, the tool spindle and a tool received thereon are located. By the at least one damping element the gripping side can be decoupled from the drive side. Vibrations and vibration loads at the hand tool usually are generated at the drive side. The vibration-damping coupling between the gripping side and the drive side effects a damping of vibrations perceivable at the gripping side.

According to a preferred development the at least one damping element in the mounted state comprises an L-shaped cross section, in particular having at least substantially an L-shaped cross section, wherein a first leg of the cross section is defined by the peripheral section, and wherein a second leg is defined by the axial section. Apart from that depending on the design of the inner housing and the outer housings the damping element may substantially have a straight extension perpendicularly to the cross section. Is is also perceivable that the damping element in the mounted state comprises a bent extension perpendicularly to the L-shaped cross section. The damping element exemplarily may be configured as a rotationally sectioned body.

According to a further development a plurality of damping elements in the non-mounted state is arranged star-shaped, connected with each other, wherein in the mounted state at least a part of the axial section of each damping element is coupled with a common ring structure. Such a star-shaped design or connection, respectively, of the damping elements in the non-mounted state may also be configured plate-shaped. Exemplarily a closed or an open ring structure may be provided, from which the sections extend radially to the outside, which later in the mounted state form the peripheral section and possibly at least a part of the axial section. However, it is also perceivable that a plurality of damping elements are arranged in a sequence and coupled with a common web that connects the axial sections on the damping elements with each other.

A structure of a plurality of damping elements may have advantages from a manufacturing view. In particular the assembly of the hand tool may be simplified, since less separate parts must be assembled. The structure of the damping elements basically may be ring-shaped or row-shaped. Since the damping elements are deformable, the final shape may simply be generated by the assembly between the outer housing and the inner housing. The ring or web that connects the individual damping elements with each other, can also be used for sealing a radial gap between the inner housing and the outer housing. This may also be advantageous with respect to the coolant air guidance or with respect to the cooling of the drive unit, respectively.

According to a further development the outer housing comprises at least one support, in particular a receiving pocket, for the at least one damping element, wherein the support comprises at least one peripheral wall and a longitudinal stop, in particular an axial stop, wherein the peripheral section of the at least one damping elements in the mounted state contacts the peripheral wall, and wherein the axial section of the at least one damping element in the mounted state contacts the longitudinal stop. In this way at the outer housing, in particular at its inner contour, a defined receiving contour for the damping element or the damping elements can be provided.

According to a development of this design the at least one support comprises a first longitudinal stop and a second longitudinal stop which are arranged at an axial distance along the drive axis, wherein an axial distance $L_2$ between the first longitudinal stop and the second longitudinal stop is smaller than a length $L_1$ of an axial side of the damping element in the non-mounted plate-shaped state.

In other words the damping element may be designed so that in the non-mounted plate-shaped state it is simply too long for the receiving pocket, so that a section of the damping element, the axial section, is formed to the outside during joining of the inner housing with the outer housing. The axial section thus may be bent over or turned over.

However, basically it is also perceivable that the support or the receiving pocket, respectively, may have a length $L_2$ between the first longitudinal stop and the second longitudinal stop that is larger than the length $L_1$ of the axial side of the damping element (in the non-mounted, plate-shaped state). This may substantially simplify the assembly of the damping element. Also with this design in the mounted state there may form the peripheral section and the axial section of the damping element. To this end, in particular, the elasticity and the formability of the damping element coming therewith can be utilized.

Basically a substantially plate-shaped damping element in the mounted state may be contacted only sectionally in radial direction by means of the inner housing. In this way primarily the section being in contact with the inner housing is deformed, in particular compressed. This section may form the peripheral section. A residual section onto which no direct radial forces act, thus may undergo substantially less (radial) loads and deformations. This section may form the axial section. It is also perceivable that the compression at the peripheral section leads to an expansion at the axial section. In other words it is basically perceivable that the peripheral section in the mounted state is compressed (radially), and that the axial section in the mounted state is stretched (radially).

In a preferred development the at least one damping element in the mounted state is received at least partially with positive fit between the outer housing and the inner housing, wherein the axial section is substantially axially biased in a neutral position, and wherein the peripheral section in the neutral position is substantially radially biased. The neutral position may be a defined relative position between the inner housing and the outer housing which for instance is taken when by the user there is not exerted any feed force onto the hand tool. The at least partially form-fit support of the damping element assists to further decrease the manufacturing or assembly effort. If the position of the damping element is secured in a positive fit, then no separate fastening element at the outer housing or the inner housing are necessary, so that the effort for parts and joining can be reduced.

According to a further development the inner housing comprises a drive section and a spindle section, wherein the spindle section includes a tool spindle that can be coupled to the drive spindle by means of a gear unit, in particular an eccentric coupling mechanism, wherein the tool spindle at its end facing away from the inner housing comprises a tool receptacle for receiving a tool.

The gear unit may be used for transforming a rotary drive motion at the drive shaft into a rotatingly oscillating output motion at the tool spindle. Rotary oscillatory output motions commonly generate a particular vibration level so that with rotary oscillatory tools it is advantageous to couple the inner housing and the outer housing vibrationally muted.

According to the development of this design the inner housing further comprises a rear end facing away from the spindle section, wherein at least sectionally a peripheral face and a front face are formed, wherein the peripheral section of the at least one damping element, preferably a plurality of damping elements, in the mounted state contacts the peripheral face, and wherein the axial section of the at least one damping element, preferably of a plurality of damping elements, contacts the front face in the mounted state.

In this way the damping element may provide an axial stop as well as a peripheral stop for the inner housing within the outer housing. The inner housing may be inserted into the outer housing starting with its rear end, cartridge-like.

It should be understood that the front face of the inner housing must not necessarily be designed exactly perpendicular to the drive axis. Instead also a conical or a bent design or a different design is conceivable that includes at least one axial component. Also with a front face not extending ideally perpendicularly to the drive axis the axial position of the inner housing may be defined sufficiently precisely.

According to a further development of the hand tool the at least one damping element in the range of the rear end of the inner housing covers a peripheral gap between the inner housing and the outer housing at least partially. It is preferred, if the peripheral gap in the range of the rear end is axially sealed or covered, respectively. This design possibly may be combined with the ring structure or web structure mentioned above for connecting a plurality of damping elements.

Principally a peripheral gap between the inner housing and the outer housing is provided for allowing (small) relative movements therebetween. In this way the outer housing can be decoupled vibrationally from the inner housing. It should be understood that this may not necessarily be a complete decoupling. By contrast, the decoupling may include a vibration damping, with which still vibrations can be sensed at the outer housing, which however are considerably reduced when compared to the vibrations of the inner housing.

A coverage or a sealing of the peripheral gap may in particular be relevant for the air guidance or the coolant air guidance, respectively, within the hand tool. The inner housing usually comprises a drive unit, the operation of which includes a heat generation. It should be possible to lead away the heat efficiently. The coolant air guidance at a hand tool with an inner housing and an outer housing that are vibrationally coupled with each other comes with several challenges. In particular the coolant air to be discharged (warmed) must be guided through the inner housing as well as through the outer housing (at least partially), for leaving the hand tool. The masking or covering of the peripheral gap between the inner housing and the outer housing may assist a directed air guidance and thus a more effective heat diversion. This may affect the life-span of the drive unit and the hand tool.

According to a further development the hand tool comprises at least one deformable coupling element being configured as a further damping element which is coupled to the outer housing and to the inner housing, wherein the at least one deformable damping element and the at least one coupling element in the mounted state commonly define a neutral position of the inner housing within the outer housing, wherein the at least one damping element and the at least one coupling element in the neutral position are at least partially biased.

According to this design there may be first type of deformable damping elements as well as a second type of deformable damping elements, the coupling elements. The damping elements and the coupling elements may commonly be referred to under the term anti-vibration elements. The vibrational decoupling between the outer housing and the inner housing thus may not only be reached by the at least one damping element according to the above-mentioned designs.

According to another development of this design the hand tool comprises a first configuration of damping elements and a second configuration of coupling elements, wherein the first configuration and the second configuration are spaced from each other at least axially, and wherein in particular the second configuration is displaced from the first configuration along the drive axis into the direction of the spindle-side end of the outer housing.

Thus the first configuration may provide a coupling of the rear end of the inner housing with the outer housing. The second configuration may provide a coupling of the spindle-side section of the inner housing with the outer housing. Commonly there may result a plurality of coupling points between the inner housing and the outer housing which effect a defined relative position and a desired guiding stiffness between the inner housing and the outer housing. It should be noted in this context that it may be advantageous to design the coupling between the inner housing and the outer housing particularly soft and yieldable in the spatial directions which match substantially with the directions of vibrations caused at the inner housing. Vice versa it may be advantageous to design the coupling between the inner housing and the outer housing in the spatial directions sufficiently stiff that coincide with directions of common feed forces that are exerted by the user in operation.

According to a preferred development the first configuration comprises three or more damping elements that are aligned with each other axially and in particular are arranged distributed in a first peripheral region of the inner housing. The second configuration may comprise two coupling elements that are aligned axially with each other and in particular are arranged in a second peripheral region of the inner housing one opposite to the other. In particular the first configuration may comprise four damping elements that preferably are arranged substantially at equal angular intervals along the periphery of the inner housing. The two coupling elements of the second configuration commonly may define an axis along which they face each other. The common axis may be perpendicular to the drive axis and perpendicularly oriented to the spindle axis and may in particular intersect the drive axis.

According to a further development the outer housing comprises a rear end that faces away from the spindle-side end of the outer housing, wherein the rear end comprises a support contour for receiving an energy storage device, wherein the rear end comprises a section that is slanted with respect to the main direction of extension that preferably effects a radial displacement of the mass balance point of a received energy storage device in the direction of a side of the drive axis opposite the tool receptacle.

According to this configuration the energy storage device may be received at the gripping side, i.e. at the side of the hand tool that is vibrationally decoupled. This may be advantageous for the life-span of the energy storage device. The energy storage device may exemplarily be configured as an accumulator package. Hand tools, in particular oscillatory tools having a shaft-shaped housing at the rear end of which an energy storage device can be received, may require particular efforts for cooling air guidance. The rear end may be obstructed by the support contour for the energy storage device. Thus at this place coolant air can be sucked or exerted only to a limited extent or not at all. Thus it is advantageous to discharge major parts of the coolant air radially from the shaft-shaped outer housing. This may require that the coolant air radially flows through the inner housing as well as through the outer housing. Thus it may be advantageous to cover or to seal the peripheral gap between the inner housing and the outer housing axially in the direction of the rear end of the outer housing.

According to further development the drive unit comprises a compact motor that is received at the inner housing, wherein in addition at the inner housing there is received a fan unit which is assigned to the compact motor, wherein the compact motor is displaced axially from the fan unit into the direction of the spindle-side end, wherein the fan unit is arranged in particular between the compact motor and the support contour for receiving the energy storage device. Compact motors in particular are suitable for hand tools that can be battery-driven. Compact motors may have a small space requirement as well as a weight-optimized design.

Commonly compact motors have a high power density. Exemplarily compact motors may be designed so that the drive shaft is supported within an integral stator housing of the compact motor. In this way the effort for bearing the drive shaft can be limited. It is advantageous when the inner housing also serves as the stator housing for the compact motor. In total there may result an integral design of the inner housing with the drive unit comprising the compact motor. The fan unit may aspire or blow off coolant air through suitable air throughput openings within the inner housing and the outer housing. In particular, the air guidance of the hand tool may be designed so that the coolant air passes at least with one radial velocity component when passing the peripheral gap between the inner housing and the outer housing. A suitable coolant air path may be provided by the axial masking of the peripheral gap by means of at least one damping element.

According to a further development in addition at the outer housing there is received a control unit for controlling the drive unit which is displaced from the fan unit into the direction of the rear end of the outer housing and which in particular is arranged between the fan unit and the support contour for receiving the energy storage device. It is advantageous to support the control unit at the outer housing, since it is thus arranged at the vibrationally decoupled gripping side of the hand tool. This may be advantageous for the life-span of the control unit.

It is understood that the afore-mentioned features and the features to be explained hereinafter cannot only be used in the given combination but also in different combinations or independently, without departing from the scope of the current invention.

BRIEF DESCRIPTION OF THE DRAWINGS

Further features and advantages of the invention can be taken from the subsequent description of several preferred embodiments with reference to the drawings. In the drawings show.

DESCRIPTION OF PREFERRED EMBODIMENTS

Figure 1:
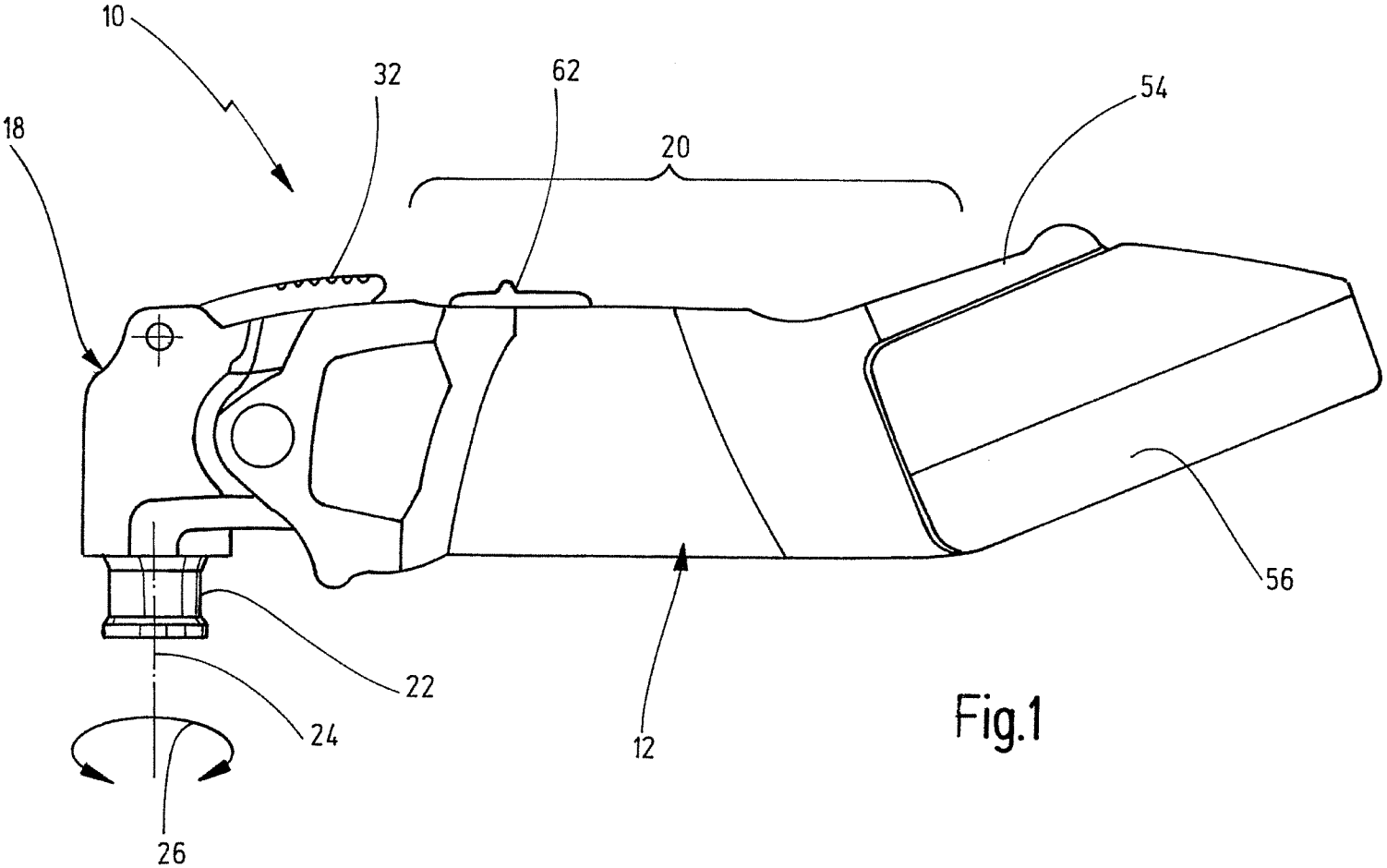
FIG. 1 a side view of a hand tool comprising an outer housing as well as a spindle section.
Figure 2:
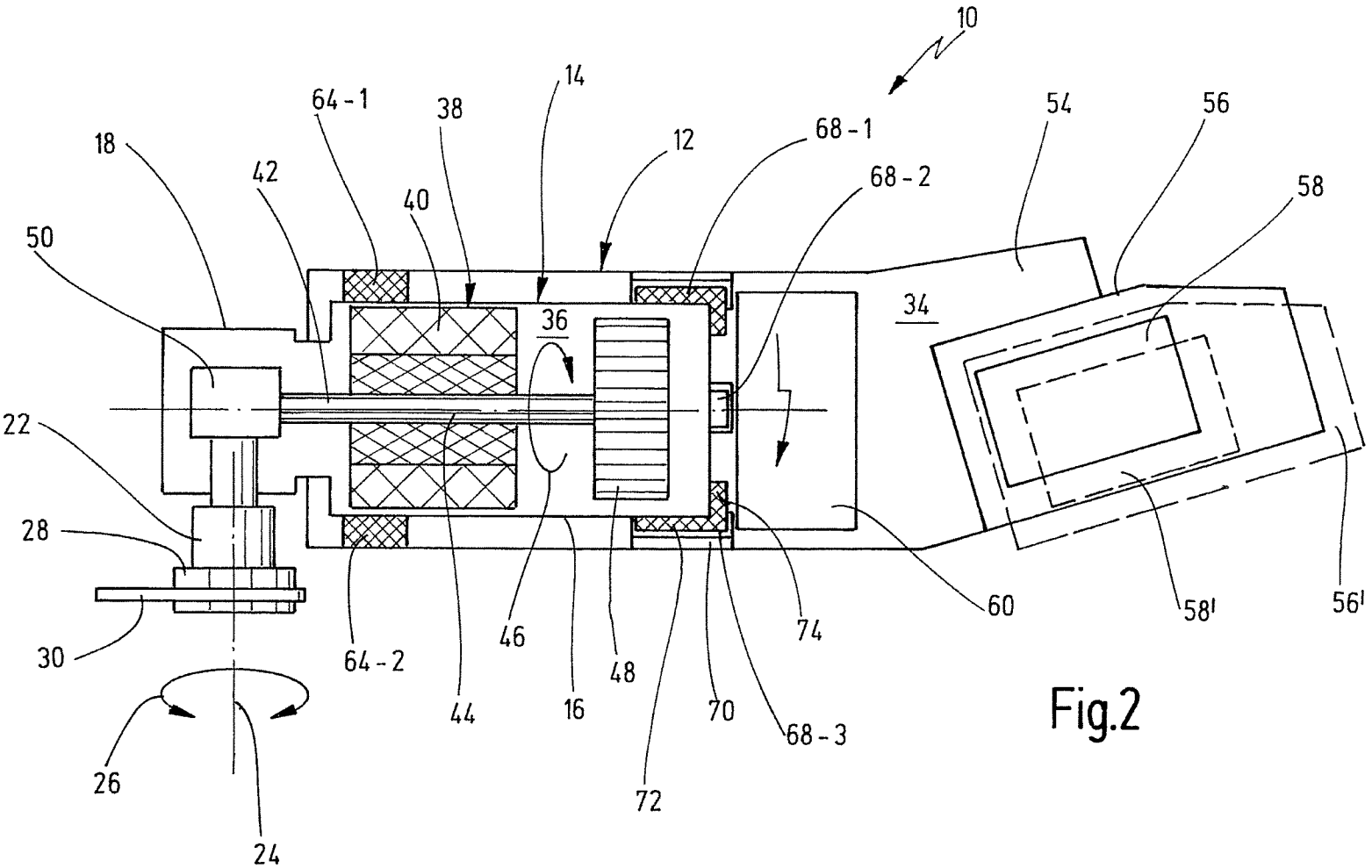
FIG. 2 a strongly simplified schematic side section through a hand tool having substantially a configuration similar to the hand tool of FIG. 1.

FIG. 1 shows a side view of a hand tool that is designated in total with 10. FIG. 2 shows a further side view of a hand tool that basically corresponds to the hand tool 10 according to FIG. 1. FIG. 1 generally refers to components of the hand tool 10 that can be seen from the outside. FIG. 2 shows a strongly simplified schematic sectional view for illustrating and explaining inner components of the hand tool 10.

The hand tool 10 exemplarily is designed as an oscillatory tool. The hand tool 10 comprises an outer housing 12 as well as an inner housing 14 that is at least partially received within the outer housing 12, see in particular FIG. 2. Basically the inner housing 14 may also be designated as a drive housing. The outer housing 12 and the inner housing 14 preferably have a relative distance to each other (in a non-loaded state). In other words it is preferred when at least in the non-loaded state there is no rigid connection or no tight contact, respectively, between the outer housing 12 and the inner housing 14.

The inner housing 14 of the hand tool 10 comprises a drive section 16 and a spindle section 18. The drive section 16 and the spindle section 18 of the inner housing 14 preferably are tightly connected with each other. Commonly the drive section 16 and the spindle section 18 may form a housing combination that is at least partially vibrationally decoupled from the outer housing 12. In other words the inner housing 14 may be supported elastically at or within the outer housing 12.

The outer housing 12 exemplarily may be designed shaft-shaped and comprises a gripping region 20 which may encompass major parts of the outer surface of the outer housing 12. The gripping region 20 may be provided in a suitable way with contourings, profilings and similar form elements. The gripping region 20 is the region which a user of the hand tool 10 may generally grip with his hands, at least with one hand, and may guide it. It is preferred when the gripping region 20 allows for a plurality of gripping positions to allow a handling of the hand tool 10 in different orientations and for different applications. It is further preferred when the gripping region 20 allows for a gripping by a left-handed person as well as by a right-handed person.

In the spindle section 18 there is received a tool spindle 22. The tool spindle 22 is configured for exerting rotary oscillations about the spindle axis 24 thereof, see also the double arrow designated with 26. At its end facing away from spindle section 18 the tool spindle 22 comprises a tool receptacle 28 at which a tool 30 may be received. For securing and exchanging a tool 30 a tool clamping device may be provided (not shown in FIGS. 1 and 2). The tool clamping device exemplarily can be operated by means of a clamping lever 32 (FIG. 1) which is supported at the spindle section 18 of the inner housing 14 and which can be pivoted between a closed state and a released state.

The inner housing 14 is assigned to a drive side 36 of the hand tool 10. The outer housing 12 is assigned to a gripping side 34 of the hand tool 10, see also FIG. 2. It is preferred when the gripping side 34 is at least partially vibrationally decoupled from the drive side 36. Oscillations or vibrations at the hand tool 10 usually are generated at the drive side 36. If the gripping side 34 is sufficiently vibrationally decoupled from the drive side 36, then only a lower vibration level acts onto the gripping side 34. In other words vibrations felt at the gripping side 34 may be muted. On the one hand this may serve to improve working ergonomics. A user may be less impaired by the vibrations of the hand tool 10 and can longer hold and guide it. In addition the life-span of components of the hand tool 10 which are supported at the gripping side 34 may be extended, since smaller mechanical loads occur.

At the inner housing 14 a drive unit 38 is received comprising a motor 40, see FIG. 2. The motor 40 may in particular be designed as a compact motor. The inner housing 14, or the drive section 16 of which, respectively, may at least partially serve as a housing for the motor 40. The motor 40 is configured for driving a drive shaft 42 rotatingly about its drive axis 44, see also an arrow designated with 46. The drive shaft 42 may be supported at the drive section 16 of the housing 14. In addition a fan unit 48 may assigned to the drive unit 38 that may be coupled exemplarily with the drive shaft 42 at a side facing away from the spindle section 18 of the motor 40. The fan unit 48 may comprise at least a fan wheel which is configured for aspiring and/or blowing out coolant air. During operation of the hand tool 10 in particular in the region of the motor 40 heat may be generated. An effective cooling thus may affect the power capacity and the life-span of the hand tool 10 advantageously. Due to the "double casing" design of the hand tool 10 with the outer housing 12 and the inner housing 14 it may be required to guide or direct, respectively, coolant air through cavities within the inner housing 14 as well as through cavities within the outer housing 12. This may for instance be affected through suitable passage openings for coolant air (not shown in FIG. 2).

In the hand tool 10 configured as an oscillatory tool the drive shaft 42 is coupled to the tool spindle 22 by means of an eccentric coupling mechanism 50. For instance the eccentric coupling or eccentric coupling mechanism 50 may comprise an eccentric fork arranged at the spindle side that cooperates with a crowned bearing with an eccentric shoulder at the spindle-side end of the drive shaft 42 (not shown in more detail in FIG. 2). With respect to the design of the eccentric coupling mechanism 50 and a suitable design of the tool clamping device referral is made for instance to WO 2005/102605 A1.

The outer housing 12 at its end facing the tool spindle 22 comprises a support or a receiving contour 54 at which an energy storage device 56 may be supported, see also FIG. 1. The energy storage device 56 exemplarily may be released from the outer housing 12, see also the dashed representation of the energy storage device 56 designated with 56' in the released state in FIG. 2. The energy storage device 56 may comprise at least one energy storage cell 58, 58'. The energy storage device 56 may in particular be an accumulator package.

In addition at the outer housing 12—i.e. at the gripping side 34—of the hand tool 10 exemplarily there is received a control unit 60. In addition a switch 62 is received at the outer housing 12. The control unit 60 and the switch 62 thus are received at the gripping side 34 that is vibrationally decoupled and thus is only subject to vibrational loads that are muted, at most. In this way the life-span of the control unit 60 and the switch 62 may be improved. The control unit 60 for instance may be configured for controlling the drive unit 38 and the fan unit 48. To this end the control unit 60 may be coupled with the drive unit 38, the switch 62 and the energy storage device 56 by means of suitable wires.

Figure 3B:
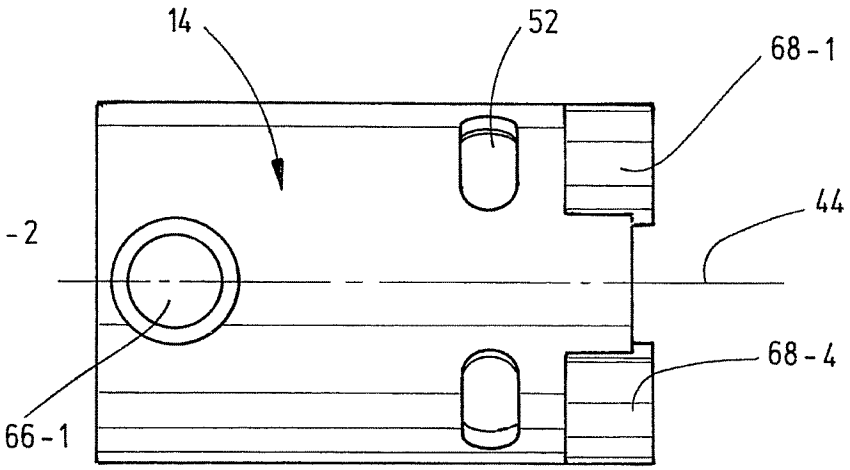
FIGS. 3*a*, 3*b* strongly simplified, schematic representations of an inner housing for a hand tool, in the rear region of which damping elements are mounted, shown in a rear view (FIG. 3*a*) and in a side view (FIG. 3*b*)
Figure 3A:
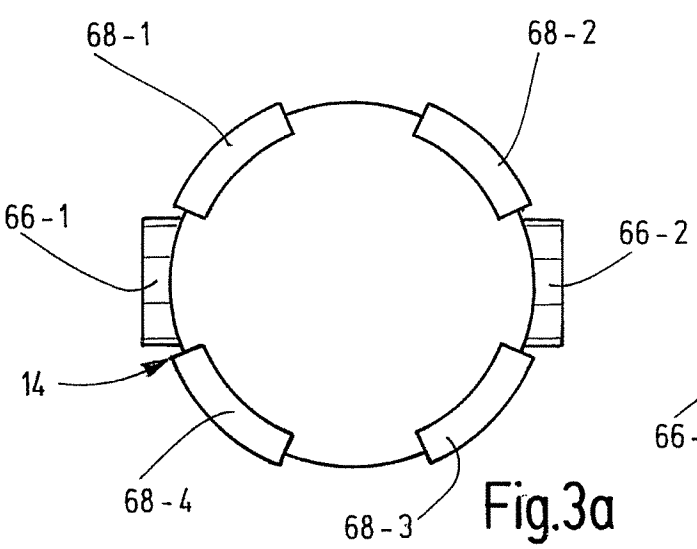
Figure 3C:
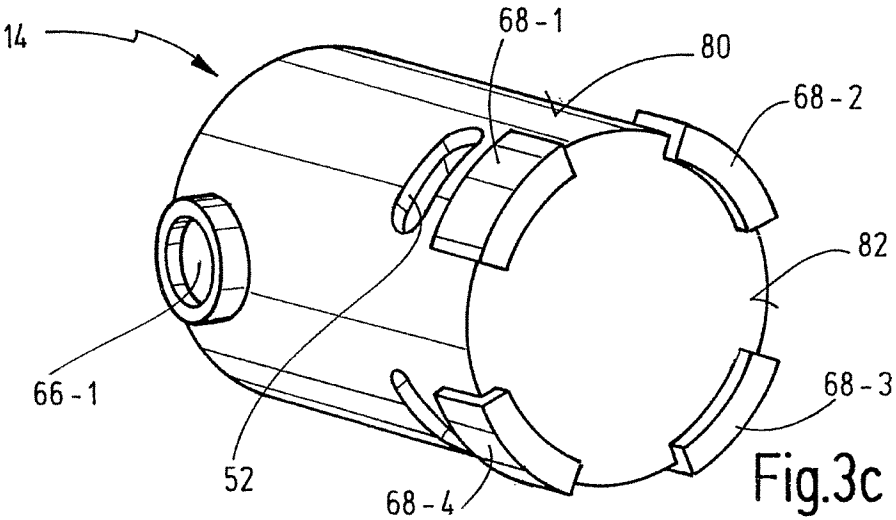
FIG. 3*c* a perspective rear view of the inner housing according to FIGS. 3*a* and 3*b;*

Referring to FIG. 2, as well as to FIGS. 3*a*, 3*b* and 3*c* the vibration-muting coupling of the inner housing 14 to the outer housing 12 is explained in more detail. FIGS. 3*a*, 3*b* and 3*c* show strongly schematically simplified representations of the inner housing 14. It may in particular be the drive section 16 of the inner housing 14, see also FIG. 2. For ease of illustration a more detailed representation of the spindle section 18 was dispensed with.

The inner housing 14 may be coupled with the outer housing 12 by means of several coupling elements or damping elements 64, 68. Elements for vibration-muting coupling of the inner housing 14 with the outer housing 12 generally may also be designated as anti-vibration elements. At the hand tool 10 different kinds of anti-vibration elements may be provided. It is also conceivable that the hand tool 10 is only equipped with one type of anti-vibration elements. According to the design shown in FIG. 2 the inner housing 14 is coupled with the outer housing 12 by means of coupling elements 64-1, 64-2 as well as by means of damping elements 68-1, 68-2, 68-3 and 68-4 (not shown in FIG. 2, see also FIG. 3*c*). The coupling elements 64 may be of one type. The damping elements 68 may be of a type different from the type of the coupling elements 64. The representation of the coupling elements 64 and the damping elements 68 in FIG. 2 is shown only schematically for representation.

The coupling elements 64 may form a configuration which is axially displaced from a configuration formed by the damping elements 68. The configuration of the coupling elements 64 may be axially displaced from the configuration of the damping elements 68 into the direction of the spindle-side end of the inner housing 14. The coupling elements 64 may be supported in a suitable way in the jointed or mounted state at supports 66-1, 66-2 of the inner housing 14 (see. FIGS. 3*a*, 3*b* and 3*c*) as well as at assigned counter contours within the outer housing 12 (not shown). It is preferred when at the inner housing 14 two supports 66-1, 66-2 are supported for receiving two coupling elements 64-1, 64-2. The position of the coupling elements 64-1, 64-2 in FIG. 2 differs from the position of the supports 66-1, 66-2 in FIGS. 3*a*, 3*b* and 3*c*, for ease of representation. It is advantageous when the supports 66-1, 66-2 define a common axis that is perpendicular to the drive axis 44 and perpendicular to the spindle axis 24.

Figure 4:
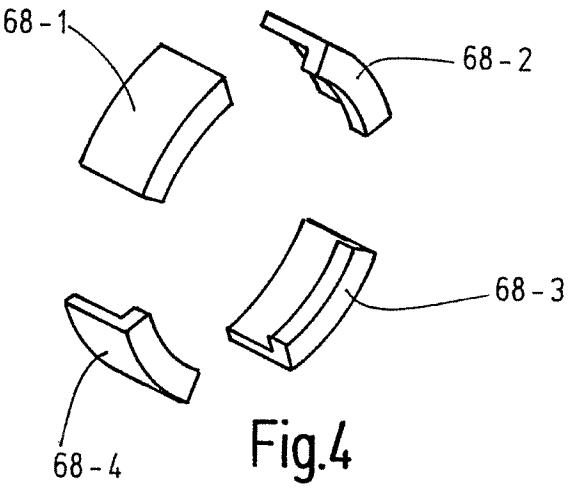
FIG. 4 a perspective rear view of a configuration of damping elements in the mounted state that may couple an inner housing and an outer housing of a hand tool with each other.

The configuration of the damping elements 68 may be received at a rear end of the inner housing 14 that faces away from the spindle-side end. It is preferred, when a plurality of damping elements 68-1, 68-2, 68-3, 68-4 is arranged at a periphery of the inner housing 14 in the rear-end region thereof, see. FIGS. 3*a* and 3*c*. FIG. 4 shows a representation of the (mounted) damping elements 68 without showing the inner housing 14, in an orientation that is similar to the orientation according to FIG. 3*c*. It is preferred, when the four damping elements 68 are supported at a periphery of the inner housing 14 in a distributed way, in particular distributed at equal angular intervals.

At the inner housing 14 in addition there may be provided air passage openings 52 for coolant air (see. FIGS. 3*b* and 3*c*), which may be assigned to a fan wheel of the fan unit 48 (see FIG. 2). Coolant air may be blown out of the inner housing 14 or may sucked in, respectively, through the air passage openings 52.

Figure 5B:
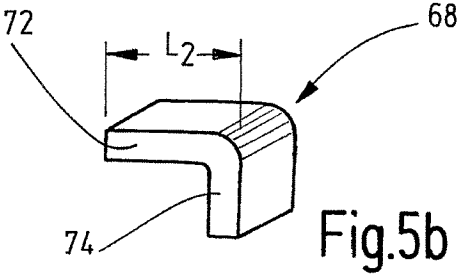
FIGS. 5*a*, 5*b* strongly simplified perspective views of a damping element in a non-mounted state (FIG. 5*a*) and in a mounted, deformed state (FIG. 5*b*)
Figure 5A:
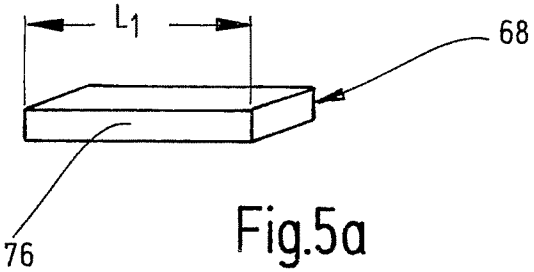

FIGS. 5*a* and 5*b* show a possible configuration of the damping elements 68. FIG. 5*a* illustrates a non-mounted state within which the damping element 68 is substantially non-loaded. FIG. 5*b* shows a mounted, assembled state within which the damping element 68 was brought into shape by means of the outer housing 12 and the inner housing 14. It is preferred, when the damping element 68 in the non-mounted state has a generally plate-shaped or rectangular-shaped form 76. For instance the damping element 68 in the non-mounted state may have the shape of a rectangular plate. In this way the damping element 68 may be manufactured at low cost and at high quantities. The damping element 68 in particular is made of a deformable material that is suitable for damping, at least in sections. These may be rubber materials, rubber-like materials, foamed materials, elastomeric materials, thermoplastic elastomeres or similar materials. It is preferred, when the damping element 68 acts damping, at least in sections. Thus the damping element 68 may attenuate occuring loads by inner friction and may decrease the energy load in a corresponding way.

The damping element 68 in FIG. 5*b*, in the mounted state, generally has a L-shaped cross section. It will be understood that the state exemplified by FIG. 5*b* generally only occurs in a deformed state. The damping element 68 in the mounted position comprises a peripheral section 72 and an axial section 74 which may form the legs of the L-shaped cross section. Between the peripheral section 72 and the axial section 74 there may be a transitional region which may in particular be rounded or bent, respectively. In the mounted state the peripheral section 72 may be mated to a length $L_2$ of a receiving pocket 70 (see FIG. 2), which is smaller than the released length $L_1$ of the damping element 68 in the non-mounted state, see FIG. 5*a*. In other words the damping element 68 may be designed "too long" for the receiving pocket 70, so that during mounting an end section is bent or folded, respectively, and forms the axial section 74.

Also the damping elements 68 exemplified by FIGS. 3*a*, 3*b* and 3*c* have an L-shaped cross section that is generated by such a deformation. For ease of explanation the transition between the peripheral section 72 and the axial section 74 in FIGS. 3*a*, 3*b* and 3*c* is shown rectangular. However it can be assumed that at least with some configurations a rounded transition similarly to FIG. 5*b* is generated.

The peripheral section 72 generated by the deformation of the damping element 68 may rest against a peripheral face 80 of the inner housing 14, see FIG. 3*c*. In the same way the axial section 74 formed by the deformation may rest against the front face 82 of the inner housing 14. In this way the mounted damping elements 68 may define the position of the inner housing 14 relative the outer housing 12 axially and radially. The damping elements 68 may transmit radial and axial loads between the inner housing 14 and the outer housing 12.

Figure 6B:
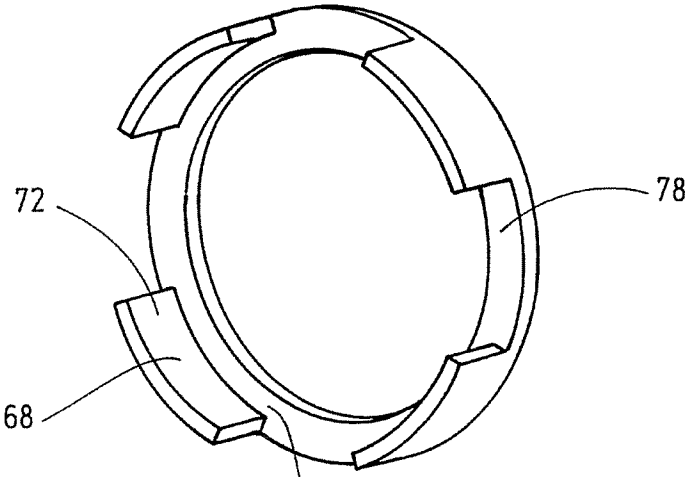
FIGS. 6*a*, 6*b* strongly simplified perspective views of a configuration of damping elements having a common ring structure, shown in a non-mounted state (FIG. 6*a*) and in a mounted state (FIG. 6*b*)
Figure 6A:
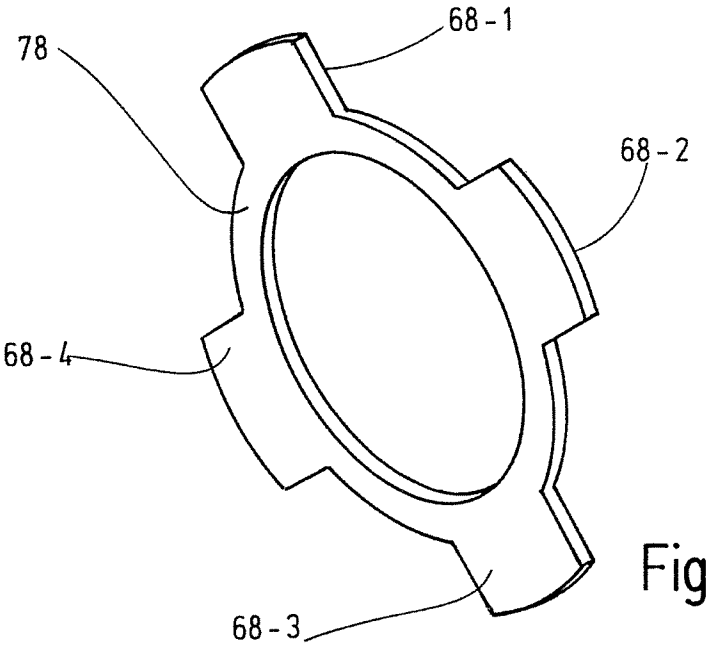

With reference to FIGS. 6*a* and 6*b* an alternative design of the damping elements 68 is explained. It may be advantageous to arrange the damping elements 68-1, 68-2, 68-3, 68-4 star-shaped in the non-mounted state and to combine them by a common ring structure 78. The design in the non-mounted state still may be flat or plate-shaped. In the mounted state, see. FIG. 6*b*, the ring structure 78 may form the axial section 74 or at least a part thereof. The ring structure 78 in the mounted state may cover or seal a peripheral gap between the inner housing 14 and the outer housing 12. This may be advantageous with respect to the air guidance.

FIGS. 7*a*, 7*b* and FIGS. 8*a*, 8*b* show different conceivable mounting situations of damping elements 68 which may e.g. be designed according to FIGS. 5*b* and 6*b*. The orientation is depicted in FIGS. 7*a*, 7*b*, 8*a* and 8*b* with an arrow each depicted with 92 that is directed to the tool spindle 22, thus pointing "to the front".

Figure 7A:
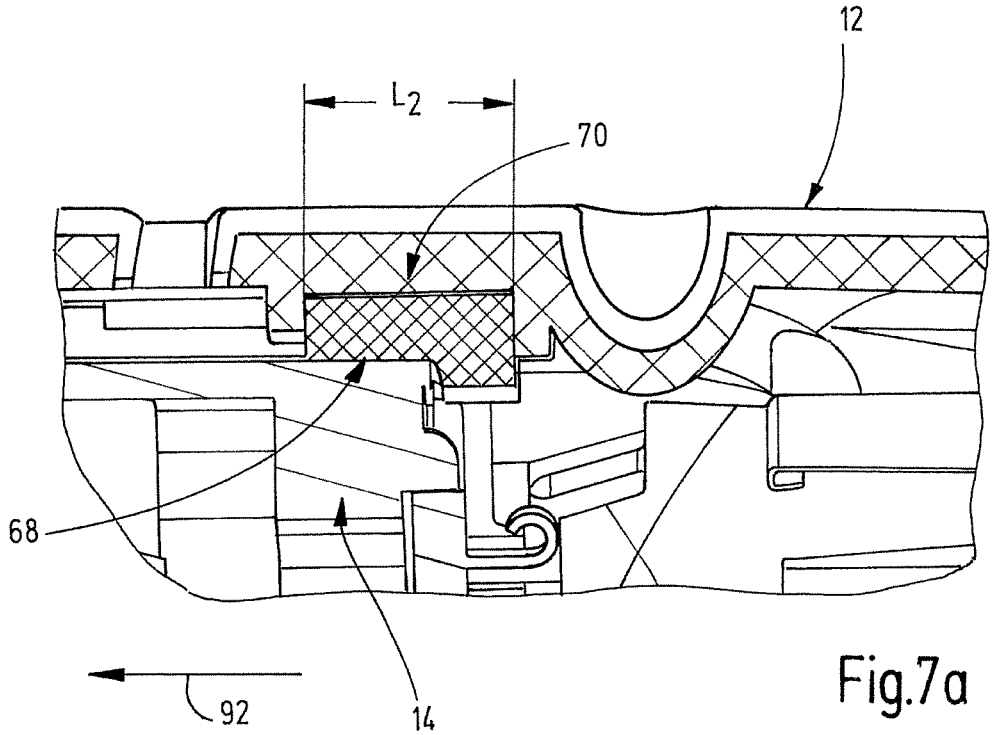
FIG. 7*a* a partial section of an outer housing and an inner housing of a hand tool that are coupled with each other by means of a damping element.

FIG. 7*a* shows a cross-section through the outer housing 12 and the inner housing 14 of a hand tool 10. In the outer housing 12 there is formed a receiving pocket 70 for the damping element 68. The receiving pocket 70 may provide a support length $L_2$ which is smaller than a length $L_1$ of the damping element 68 in the flat, non-loaded state, see also FIGS. 5*a* and 5*b*. In this way the damping element 68 may be deformed in the region of a longitudinal stop 86 of the receiving pocket 70, to form the axial section 74, see also FIG. 7*b*.

As mentioned above already it is also conceivable that the support length $L_2$ is lager than the length $L_1$ of the damping element 68 in a flat, non-loaded state. This may simplify the mounting of the damping element 68. The outer housing 12 then can contact the damping element 68 along the total length $L_2$ of the receiving pocket 70 (radially). The inner housing 14 can contact the damping element 68 within an axial section (radially) which later forms the peripheral section 72. Thus radial loads may in particular occur at the peripheral section 72. This may lead to a deformation of the peripheral section 72, such as to a decrease in the thickness of the peripheral section 72. Also this load may effect an invasion or a thickness balancing, respectively, at the axial section 74. The radial thickness of the axial section 74 may increase so that the axial section 74 due to this expansion may contact the front face 82 (see also FIG. 7*b*) of the inner housing 14.

Figure 7B:
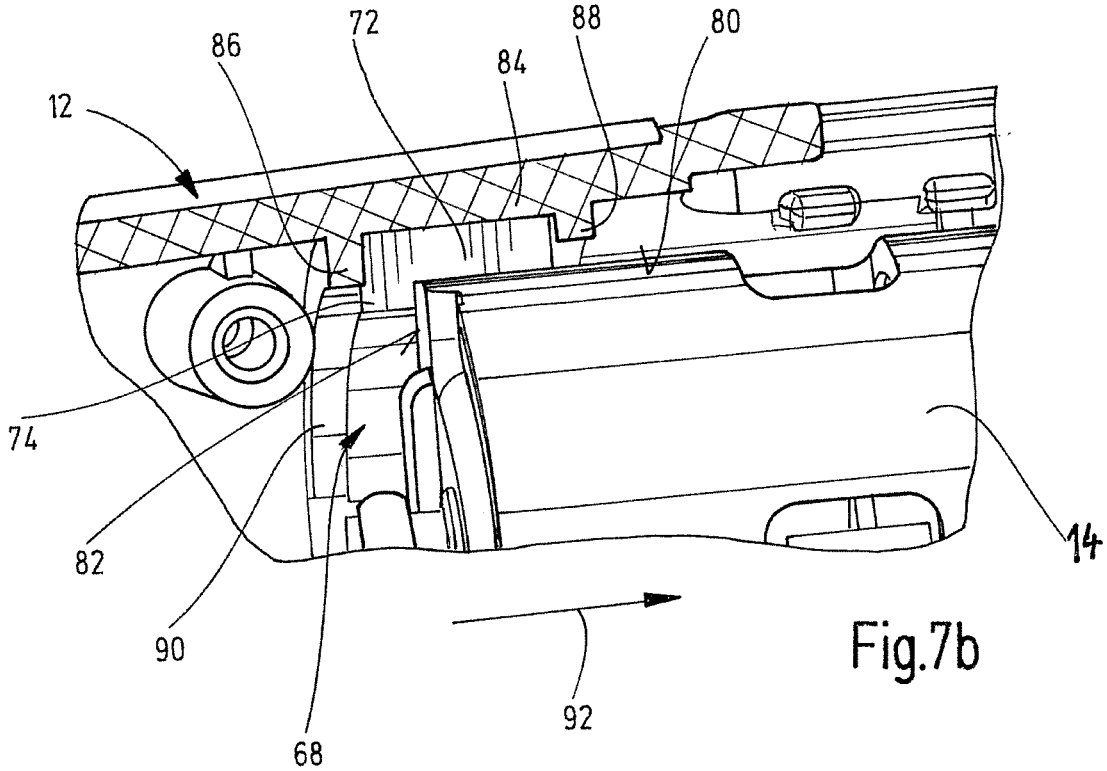
FIG. 7*b* a partially sectioned perspective view of a design according to FIG. 7*a* shown rearwardly oriented.

FIG. 7*b* shows a mounting situation that is comparable to the one of FIG. 7*a*, wherein however only the outer housing 12 is shown sectioned. The receiving pocket 70 comprises a peripheral wall 84, the longitudinal stop 86 as well as a further longitudinal stop 88. The peripheral wall 84 in the mounted state is contacted by the peripheral section 72. The peripheral section 72 extends between the first longitudinal stop 86 and the second longitudinal stop 88. The axial section 74 of the damping element 68 rests agianst the first longitudinal stop 86. In particular the first longitudinal stop 86 may be designed in the shape of a rib 90. It is preferred, when the first longitudinal stop 86 starting from the outer housing 12 protrudes further radially to the inside into the direction of the drive axis 44 than the second longitudinal stop 88. This may simplify the assembly of the damping elements 68 and the inner housing 14.

The peripheral wall 84 and the peripheral face 80 include the peripheral section 72 between each other. The longitudinal stop 86 and the front face 72 include the axial section 74 between each other. If at the damping element 68 a ring structure 78, see FIGS. 6*a* and 6*b*, is formed, then a peripheral gap between the inner housing 14 and the outer housing 12 may be fully obstructed or covered, respectively. It will be understood that such an "obstruction" should not be completely stiff to not impair the damping effect of the damping elements 68 excessively. By contrast it may be advantageous, when only geometries are generated that avoid an exit or an insertion of coolant air in the rearward end region of the inner housing 14 into the peripheral gap between the inner housing 14 and the outer housing 12. Also without a ring structure 78 the axial sections 74 may act obstructing and/or covering in their respective peripheral sections.

Figure 8A:
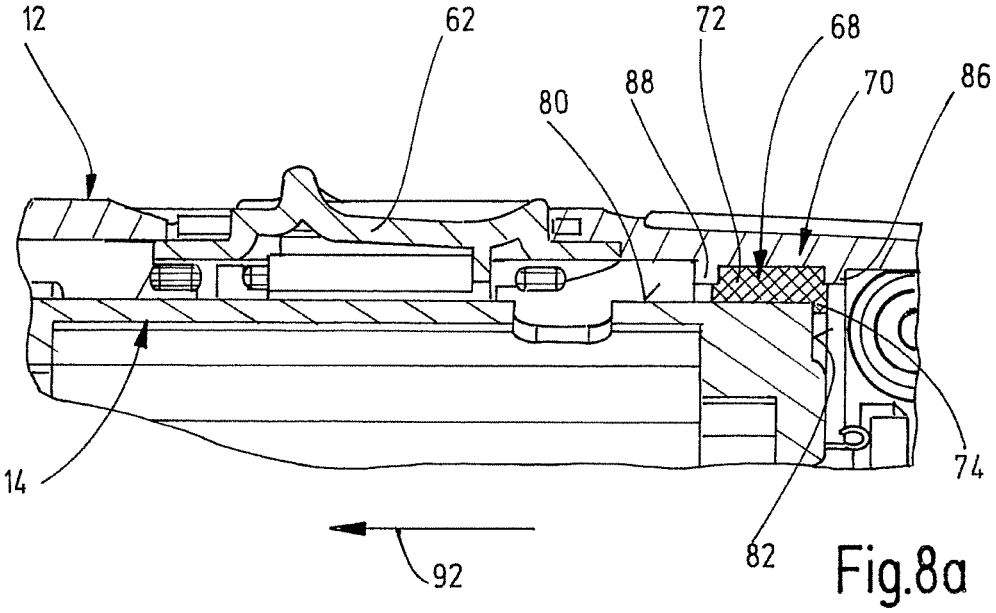
FIG. 8*a* a sectioned partial side view of an outer housing and an inner housing of a hand tool which are coupled with each other by a damping element.
Figure 8B:
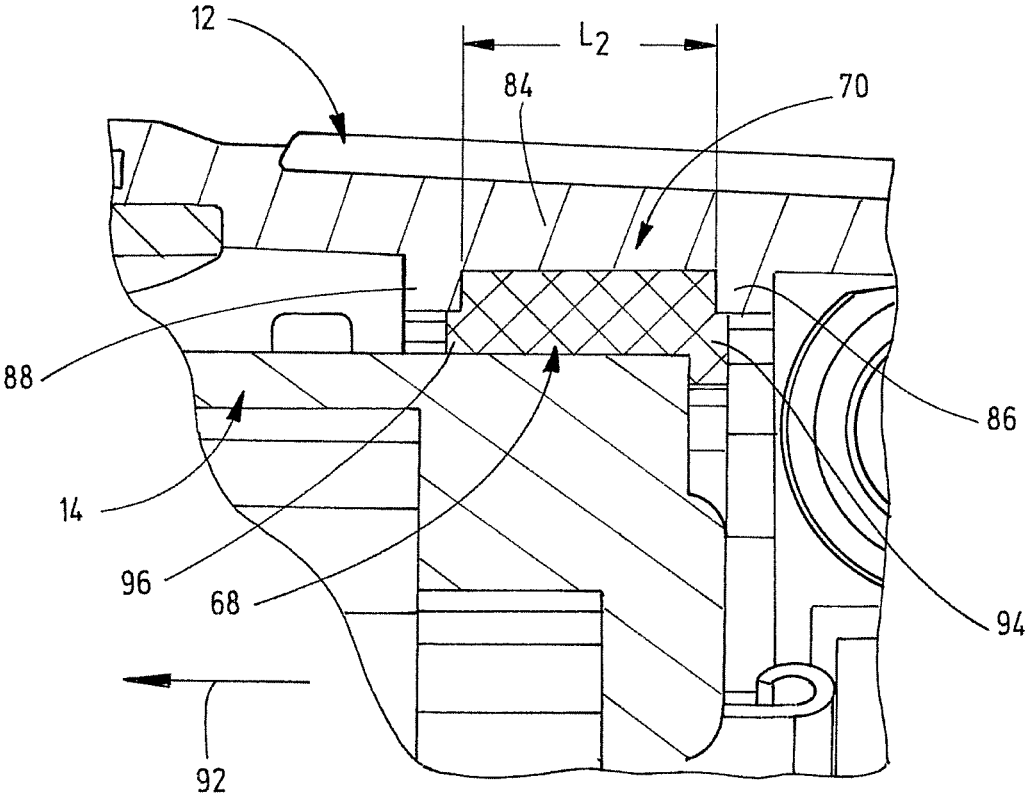
FIG. 8*b* an enlarged representation of the design according to FIG. 8*a*, shown in the region of the damping elements.

The design of the damping elements 68 and the receiving pockets 70 which is illustrated with reference to FIGS. 8*a* and 8*b* is basically similar to the design according to FIGS. 7*a* and 7*b*. FIG. 8*a* shows a lateral section through the outer housing 12 and the inner housing 14. FIG. 8*b* shows an enlarged cross section of the representation according to FIG. 8 in the region of a damping element 68 which is received at a receiving pocket 70.

The peripheral section 72 is received between the first longitudinal stop 86 and the second longitudinal stop 88 in a known way. In addition the peripheral section 72 contacts the peripheral wall 84 of the receiving pocket 70. Depending on which damping material the damping element 68 is made of, after the mounting of the inner housing 14 and the outer housing 12 there may form protrusions 94, 96 at the damping element 68 which axially protrude beyond the length $L_2$ defined by the longitudinal stops 86, 88. The protrusion 94 is assigned to the axial section 74 or forms a substantial part of the axial section 74, respectively. The protrusion 96 is assigned to the peripheral section 72.

With the damping elements 68 an axial as well as a radial positioning between the inner housing 14 and the outer housing 12 may be performed at low manufacturing expenditure. In particular the damping elements 68 in the mounted state can provide a radial and an axial biasing force for the inner housing 14. A coolant air flow between the inner housing 14 and the outer housing 12, in particular within a peripheral gap between the inner housing 14 and the outer housing 12, can be sufficiently sealed and guided. Such designs in particular are suitable for battery-operated hand tools 10 which are equipped with energy storage devices 56 at the rear side.

What is claimed is:

1. A hand tool, comprising:

an outer housing having at least a gripping region;

an inner housing being at least partially arranged within said outer housing and being coupled therewith vibration-muted;

a drive unit received within said inner housing and including a drive shaft;

a tool spindle received within said inner housing;

a gear received within said inner housing and being coupled to said drive shaft and to said tool spindle for driving said tool spindle about a longitudinal axis thereof;

a deformable damping element coupling said outer housing and said inner housing, said damping element comprising a common ring structure and multiple, spaced apart tabs extending from the common ring structure, wherein in a non-mounted state, said damping element is a planar, unbent member, and wherein in a mounted state, said tabs of said damping element are bent, such that, in cross-section, each respective one of said tabs form an L-shape with said common ring structure, with said tabs forming peripheral sections and said common ring structure forming an axial section;

wherein said peripheral sections in said mounted state are generally configured for transmitting radial forces between said outer housing and said inner housing;

wherein said axial section in said mounted state is generally configured for transmitting axial forces between said outer housing and said inner housing.

2. The hand tool of claim 1, wherein said drive shaft is driven rotatingly, and wherein said gear is configured for driving said tool spindle rotatingly oscillatingly about said longitudinal axis thereof.

3. The hand tool of claim 1, wherein said outer housing comprises a gripping side, wherein said inner housing with said drive unit comprises a drive side, and wherein said peripheral sections and said axial section of said damping element each have a peripheral distance and an axial distance between said outer housing and said inner housing.

4. The hand tool of claim 1, wherein said outer housing comprises at least one receiving pocket for said damping element, wherein said at least one receiving pocket comprises at least a peripheral wall and a first longitudinal stop, wherein said peripheral sections of said damping element, in said mounted state, contact said peripheral wall, and wherein said axial section of said damping element contacts said first longitudinal stop in said mounted state.

5. The hand tool of claim 4, wherein said at least one receiving pocket further comprises a second longitudinal stop, wherein said first longitudinal stop and said second longitudinal stop are axially spaced from each other along a drive axis of the drive shaft, and wherein an axial distance between said first longitudinal stop and said second longitudinal stop is smaller than a length of said damping element in said non-mounted state, said damping element being plate-shaped in said non-mounted state.

6. The hand tool of claim 1, wherein said damping element in said mounted state is received between said outer housing and said inner housing at least partially with a positive fit, wherein said axial section in a neutral position is substantially axially biased, and wherein said peripheral sections in said neutral position are substantially radially biased.

7. The hand tool of claim 1, wherein said drive shaft is driven rotatingly, and wherein said gear is an eccentric coupling mechanism being configured for driving said tool spindle rotatingly oscillatingly about said longitudinal axis thereof.

8. The hand tool of claim 7, wherein said inner housing further comprises a rear end facing away from said tool spindle, at which a peripheral face and a front face are formed at least partially, wherein said peripheral sections of said damping element contact, in said mounted state, said peripheral face, and wherein said axial section of said damping element contacts said front face in said mounted state.

9. The hand tool of claim 8, wherein said damping element, at said rear end of said inner housing, at least partially obstructs a peripheral gap between said inner housing and said outer housing.

10. The hand tool of claim 1, further comprising at least one deformable coupling element, being configured as a coupling element for damping, being coupled with said outer housing and said inner housing, wherein said damping element and said at least one deformable coupling element, in said mounted state, commonly define a neutral position of said inner housing within said outer housing, wherein said damping element and said at least one deformable coupling element, in said neutral position, are at least partially biased.

11. The hand tool of claim 10, wherein said damping element is at least axially displaced from said at least one deformable coupling element, and wherein said at least one deformable coupling element is displaced along a drive axis of the drive shaft into a direction of a spindle-side end of said outer housing.

12. The hand tool of claim 11, wherein said at least one deformable coupling element comprises two coupling elements which are axially aligned with each other and which are arranged within a peripheral region of said inner housing opposite to each other.

13. The hand tool of claim 1, wherein said outer housing comprises a rear end facing away from a spindle-side end of said outer housing, wherein said rear end comprises a receiving contour for supporting an energy storage device, and wherein said rear end comprises a section that is slanted with respect to the main direction of extension.

14. The hand tool of claim 13, wherein said drive unit comprises a compact motor which is received at said inner housing, said compact motor further including a fan unit, said fan unit being axially displaced from said compact motor into a direction opposite to a spindle-side end of said outer housing.

15. The hand tool of claim 14, wherein said fan unit is arranged between said compact motor and said receiving contour for supporting said energy storage device.

16. A hand tool, comprising:

an outer housing having at least a gripping region;

an inner housing being at least partially arranged within said outer housing and being coupled therewith vibration-muted;

a drive unit received within said inner housing and including a drive shaft which can be driven rotatingly;

a tool spindle received within said inner housing;

a gear received within said inner housing and being coupled to said drive shaft and to said tool spindle for driving said tool spindle about a longitudinal axis thereof;

at least one deformable damping element coupling said outer housing and said inner housing, said at least one damping element comprising a common ring structure and multiple, spaced apart tabs extending radially from said common ring structure in a non-mounted state, and in a mounted state said tabs are bent to extend axially from said common ring structure, such that, in cross-section, each respective one of said tabs form an L-shape with said common ring structure;

wherein said common ring structure, in said mounted state, is generally configured for transmitting axial forces between said outer housing and said inner housing;

wherein said tabs, in said mounted state, are generally configured for transmitting radial forces between said outer housing and said inner housing.

17. A hand tool, comprising:

an outer housing having at least a gripping region;

an inner housing being at least partially arranged within said outer housing and being coupled therewith vibration-muted;

a drive unit received within said inner housing and including a drive shaft which can be driven rotatingly;

a tool spindle received within said inner housing;

a gear received within said inner housing and being coupled to said drive shaft and to said tool spindle for driving said tool spindle about a longitudinal axis thereof;

a deformable damping element coupling said outer housing and said inner housing, said damping element comprising a common ring structure and multiple, spaced apart tabs extending from the common ring structure, wherein in a non-mounted state, said damping element is a planar, unbent member, and wherein in a mounted state, said tabs of said damping element are bent, such that said tabs form peripheral sections and said common ring structure forms an axial section;

wherein said peripheral sections, in said mounted state, are generally configured for transmitting radial forces between said outer housing and said inner housing;

wherein said axial section, in said mounted state, is generally configured for transmitting axial forces between said outer housing and said inner housing.

18. The hand tool of claim 17, wherein said drive shaft is driven rotatingly, and wherein said gear is configured for driving said tool spindle rotatingly oscillatingly about said longitudinal axis thereof.

19. The hand tool of claim 17, wherein said drive shaft is driven rotatingly, and wherein said gear is an eccentric coupling mechanism being configured for driving said tool spindle rotatingly oscillatingly about said longitudinal axis thereof.

* * * * *